United States Patent [19]

Nicholson

[11] 4,335,554

[45] Jun. 22, 1982

[54] ADJUSTABLE SUPPORT DEVICE TO SECURE A PATCH IN HOLLOW WALLS

[76] Inventor: Charles E. Nicholson, 1703 W. 33rd. St., Chicago, Ill. 60608

[21] Appl. No.: 163,389

[22] Filed: Jun. 26, 1980

[51] Int. Cl.[3] ..... E04G 23/02

[52] U.S. Cl. ..... 52/514

[58] Field of Search ..... 52/204, 514; 206/321, 206/223

[56] References Cited

U.S. PATENT DOCUMENTS

| | | | |
|---|---|---|---|
| 2,598,194 | 5/1952 | Shippey | 52/514 |
| 2,772,447 | 12/1956 | Preston | 52/204 X |
| 3,874,505 | 4/1975 | Mirarchi et al. | 52/514 X |
| 4,135,017 | 1/1979 | Hoffmann, Sr. | 52/514 X |
| 4,193,243 | 3/1980 | Tiner | 52/514 |

*Primary Examiner*—Alfred C. Perham

[57] ABSTRACT

An adjustable patch support to repair a hole in drywall type hollow walls.

The support attaches quickly, in a novel manner to the drywall wall material, firmly supports and integrates the patch to the wall. The support is adjustable to accommodate a patch of varied perimeters.

Most importantly, since drywall is manufactured in three standard thicknesses, the support is also adjustable to integrate a patch of any standard thickness to a drywall wall of any standard thickness.

3 Claims, 4 Drawing Figures

ADJUSTABLE SUPPORT DEVICE TO SECURE A PATCH IN HOLLOW WALLS

FIELD OF INVENTION

This device relates to hollow walls and specifically a new and useful way to patch holes in drywall or gypsum wall surfaces.

PRIOR ART

Heretofore, in order to patch a hole in hollow wall surfaces, the portion of the wall surface material with the hole was cut in the shape of a square or rectangle, removed from the wall and like thickness and shape patch inserted in its place. The patch had to be attached to a firm support in order to make it an integral part of the wall. The support must be cut to size, and fastened securely to the wall members. After the patch is applied in this manner, it is plastered around its perimeter to bond and blend to the face of the wall surface material.

Prior methods have involved gluing the support to the back of the wall surface material. The problem with this is that the glue takes time to set, making it necessary for some means to hold the support and patch in place while the glue sets.

If too much glue is applied, the face of the patch and the face of the wall will not be even and flush.

Screws are also used to fasten the support and the patch. The screws being driven through the face of the wall surface material into the support positioned in back of the wall surface material. This makes it difficult to position the support, the screw, and a tool at the same time. The screwheads, even when countersunk, are visable on the face of the wall, and must be plastered over.

Since walls are constructed of various thicknesses of wall surface material, the problem of matching patch thickness to wall surface material thickness, requires the use of various thickness patch material.

OBJECTS

The object of my invention, is to provide a new and useful device to quickly and securely apply support for a patch to the surface material of a hollow wall, to allow a patch of varied perimeters and thickness to be used in wall surface material of varied thickness, to eliminate marring of the screwheads and inconvenience of glue setting.

Further objects and advantages will become apparent from a consideration of drawings and insuring description thereof.

DRAWINGS

Figure 1:
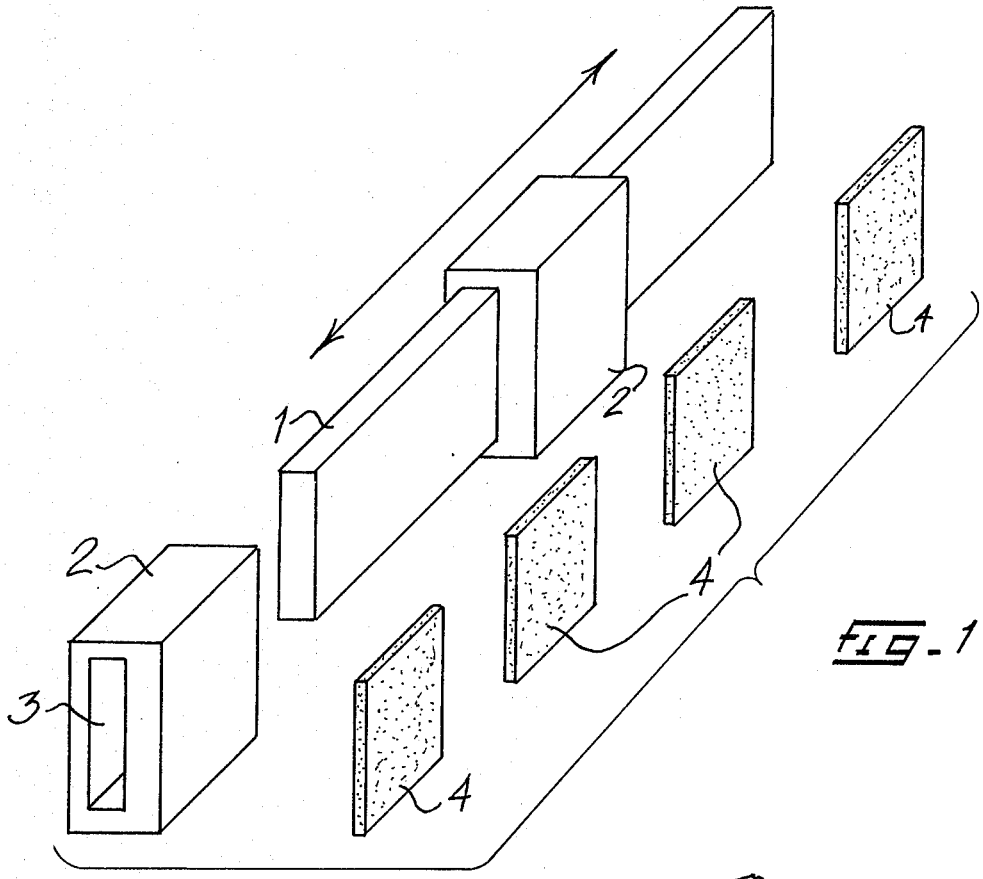

FIG. 1—is a perspective view.

Figure 2:
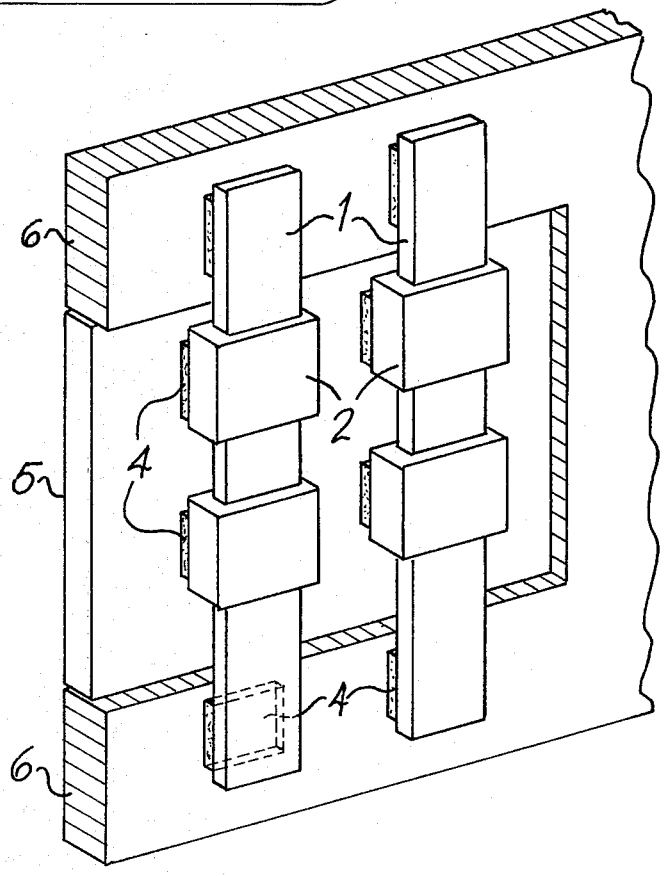

FIG. 2—is a perspective view of a section of a wall.

Figure 3:
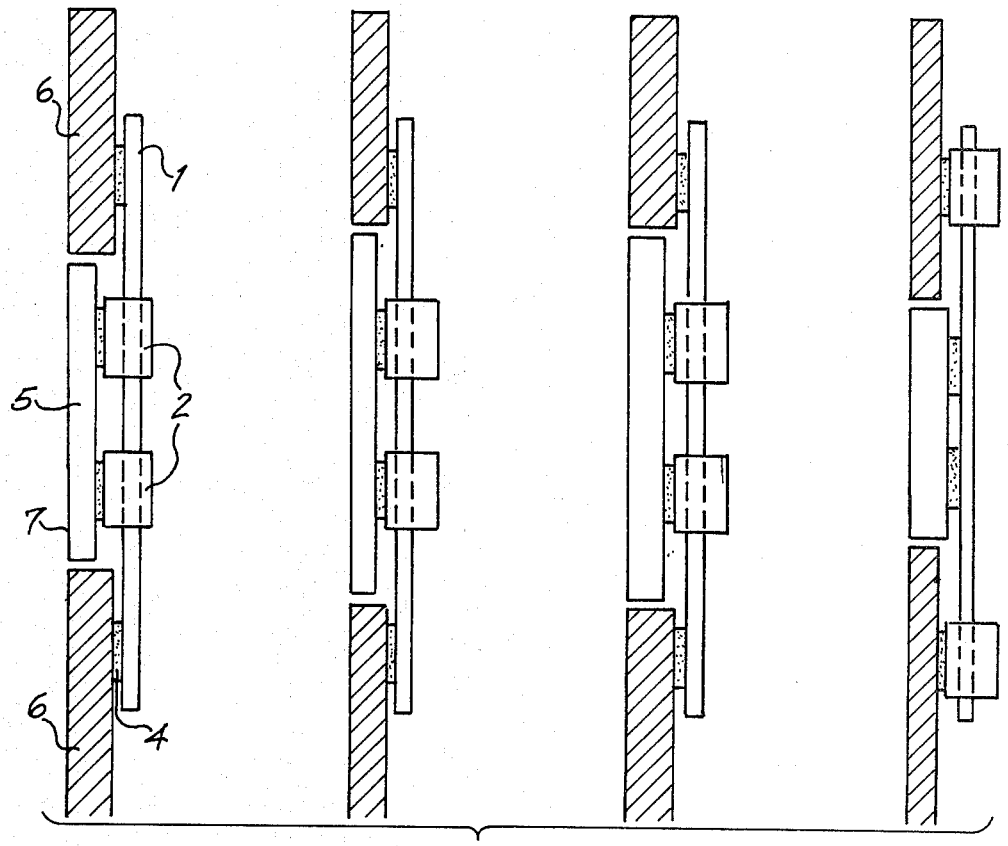
Figure 4:
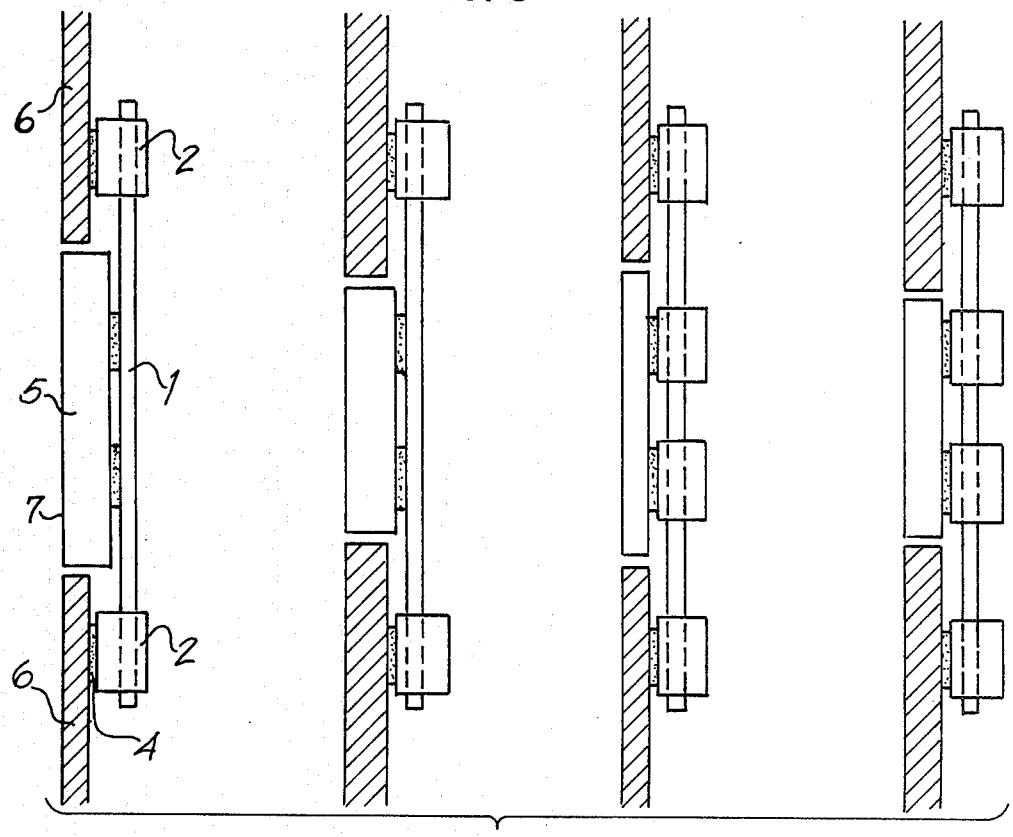

FIGS. 3 & 4—are side views of a section of a wall, and various support positions.

DESCRIPTION

Referring to FIG. 1, the illustrated device comprises: A rectangular bar 1 a pair of identical rectangular blocks 2 each having an off center slot 3 through its horizontal length, three or more pressure sensitive adhesive pads 4.

FIG. 1, the slotted blocks 2 are mounted on the bar 1 by means of the slot 3. The blocks 2 fit tightly on the bar 1 yet can move along the length of the bar 1 as indicated by the arrow.

FIG. 2, pressure sensitive adhesive pads 4 are applied to the bar 1 and blocks 2. The assembled device consisting of bar 1 blocks 2 and pressure sensitive adhesive pads 4 comprise a support for the patch 5. The support device is secured to the back of the wall surface material 6 by means of the pressure sensitive adhesive pads 4.

The patch 5 is secured to the support by means of the pressure sensitive adhesive pads 4.

FIGS. 3 & 4. The movement of the blocks 2 along the length of the bar 1 provide adjustment for a larger or smaller patch 5. The slot 3 in the block 2 is off center to effect a different dimension from the center of the slot 3 to the outer sides of the block 2. This unequal dimension is contrived to coincide with the thickness increments of standard wallboard, or gypsum base wall surface materials. The blocks 2 can be mounted on the bar 1 in various quantities and positions thereby providing adjustment to position the patch 5, so its face 7 alignes with the face of the wall surface material.

OPERATION

FIG. 2, application of the patch using the device is done in the following manner: A patch 5 is cut larger than the hole in the wall surface material, the wall surface material is cut out from the wall around the perimeter of the hole in the shape of the patch 5.

The blocks 2 are mounted on the bar 1 in the positions corresponding to patch 5 thickness and wall surface material thickness. The pressure sensitive adhesive pads 4 are applied to the surface of the support device that contact the back of the patch 5 and the back of the wall surface material 6.

The support device is inserted into the hole in the wall surface material and positioned as desired. Pressure is applied to the pressure sensitive adhesive pads 4 by pulling the support device toward the back of the wall surface material 6. This will secure the support device to the back of the wall surface material 6. The patch 5 is placed in the hole in the wall surface material against the remaining pressure sensitive pads 4 and slightly less pressure is applied to secure the patch 5 to the support device. The patch 5 is then plastered around its perimeter to bond and blend to the wall surface material.

While I have described one embodiment of the invention, it is to be understood that the invention is capable of many modifications. Changes therefore in construction and arrangement may be made without departing from the spirit and scope of the invention as defined in the appended claims.

I claim:

1. An adjustable support device to secure a patch to hollow walls comprising an elongated support member that spans an aperture in the wall surface material, braces the patch material and is secured interchangeably to either said wall surface material or said patch material an interfacing element means that interfaces and secures interchangeably to either said wall surface material or said patch material said interfacing element means having a plurality of faces and firmly mounted on said elongated support element by a mounting means said mounting means allowing said faces to be of predetermined unequal lateral distances from the longitudinal center of said elongated support member said mounting means also allowing said faces to be transposable and longitudinally positionable on said elongated support member a means to secure said elongated support member and said interfacing element means to either said wall surface material or said patch material the combination of said interfacing element means mounted in plurality by said mounting means on said elongated support member that supports said patch material of varied thickness and perimeter in said aperture of said wall surface material of varied thickness while allowing the exterior surfaces of said patch material and said wall surface material to be parallel.

2. The adjustable support device to secure a patch to hollow walls according to claim 1 where said elongated support member is a rectangular bar and said interfacing element means comprises a rectangular block having facing surfaces on its broadest sides said mounting means comprises a rectangular shaped slot going through said rectangular block on a longitudinal plane and laterally off center in respect to its broadest sides said rectangular shaped slot is of dimensional proportions to allow insertion and friction fit of said rectangular bar.

3. The adjustable support device to secure a patch to hollow walls according to claim 1 where said means to secure comprises a plurality of pressure sensitive adhesive pads.

* * * * *